US006337639B1

(12) United States Patent
Kojima

(10) Patent No.: US 6,337,639 B1
(45) Date of Patent: Jan. 8, 2002

(54) TOLL COLLECTION APPARATUS AND TOLL COLLECTION METHOD

(75) Inventor: Hideaki Kojima, Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/533,590

(22) Filed: Mar. 23, 2000

(30) Foreign Application Priority Data

Apr. 30, 1999 (JP) ..... 11-123935

(51) Int. Cl.[7] ..... G08G 1/065

(52) U.S. Cl. ..... 340/928; 235/384; 340/937; 701/117

(58) Field of Search ..... 340/928, 905, 340/937; 235/384; 701/47

(56) References Cited

U.S. PATENT DOCUMENTS 4,963,723 A * 10/1990 Masada ..... 235/384
5,771,008 A * 6/1998 Hayashi et al. ..... 340/928
5,850,191 A * 12/1998 Yagi et al. ..... 340/928
5,859,415 A * 1/1999 Blomqvist et al. ..... 340/928
5,872,525 A 2/1999 Fukasawa et al. ..... 340/928
5,969,641 A * 10/1999 Nakamura et al. ..... 340/928
6,109,525 A * 8/2000 Blomqvist et al. ..... 340/928

* cited by examiner

*Primary Examiner*—Brent A. Swarthout
(74) *Attorney, Agent, or Firm*—Pillsbury Winthrop LLP

(57) ABSTRACT

A toll collection method of a toll collection apparatus that is jointly installed with a wireless toll collection system for the toll collection is to receive the vehicle data of a vehicle of which toll could not be collected by the wireless toll collection system, collect a toll from the vehicle corresponding to the received vehicle data and transmit the vehicle data to the wireless toll collection system when the toll collection process is completed by the processing means.

3 Claims, 3 Drawing Sheets

TOLL COLLECTION APPARATUS AND TOLL COLLECTION METHOD

BACKGROUND OF THE INVENTION

1. Field of the Invention

The present invention relates to a toll collection apparatus which is installed jointly with an electric toll collection system (ETC) provided at tollgates of toll roads for the toll collection through a wireless communication with an onboard unit equipped to mobile bodies such as vehicles and the like, and a toll collection method of the toll collection apparatus.

2. Description of the Related Art

According to the technology so far available, in the case of an electric toll collection system (ETC) utilizing a wireless communication technology, all vehicles including ETC vehicles are once stopped and tolls are collected at exit lanes regardless of difference in manned/unmanned or private operations. For example, U.S. Pat. No. 5,872,525 discloses a toll collection systems. And, with the increase of the ETC utilization factor, it becomes possible to further increase the utilizing factor of toll collection process when the toll collection system is rather operated only for the full non-stop ETC private operation.

However, when the full non-stop ETC private operation is put for the use as a result of the spread of the ETC after the once stop type ETC that is examined at present is fixed, it is expected that some of vehicles force their way through the exit lane if tolls are not properly collected at the ETC private non-stop exit lanes and these vehicles may be processed as forced passing vehicles. In this case, there are some fear that erroneously processed vehicles and erroneously entered non-ETC vehicles may be regarded as forced passing vehicles even when they have no evil intention.

As described above, in the wireless toll collection system (ETC) utilizing the wireless communication technology, there was such a problem that when a full non-stop ETC private operation is provided for the use as a result of the spread of the ETC and tolls are not properly collected at the ETC private non-stop exit lanes, the vehicles of which tolls are not properly collected are processed as forced passing vehicles and erroneously processed vehicles and erroneously entered non-ETC vehicles may be regarded as forced passing vehicles even when they have no evil intention.

SUMMARY OF THE INVENTION

It is an object of the present invention to provide a toll collection apparatus that is jointly installed to and operated with a wireless toll collection system (ETC) and a toll collection method for positively collecting tolls of vehicles from which tolls could not be collected properly and preventing the generation of forced passing of tollgates.

According to the present invention, a toll collection apparatus that is installed jointly with a wireless toll collection system for toll collection. The toll collection apparatus comprises receiving means for receiving vehicle data of vehicles from which a toll could not be collected by the wireless toll collection system; processing means for performing a toll collecting process from the vehicle corresponding to the vehicle data received by the receiving means; and transmission means for transmitting the vehicle data of the vehicle to the wireless toll collection system when completing the toll collection process by the processing means.

Further, according to the present invention, a toll collection method of a toll collection apparatus that is jointly installed to a wireless toll collection system for the toll collection is provided. The toll collection method comprises the steps of receiving vehicle data of a vehicle from which a toll could not be collected by the wireless toll collection system, and transmitting the vehicle data of the vehicle to the wireless toll collecting system when the toll collection was made from the vehicle corresponding to the vehicle data received in the receiving way.

DETAILED DESCRIPTION OF THE PREFERRED EMBODIMENTS

Preferred embodiments of the present invention will be described below referring to the attached drawings.

Figure 1:
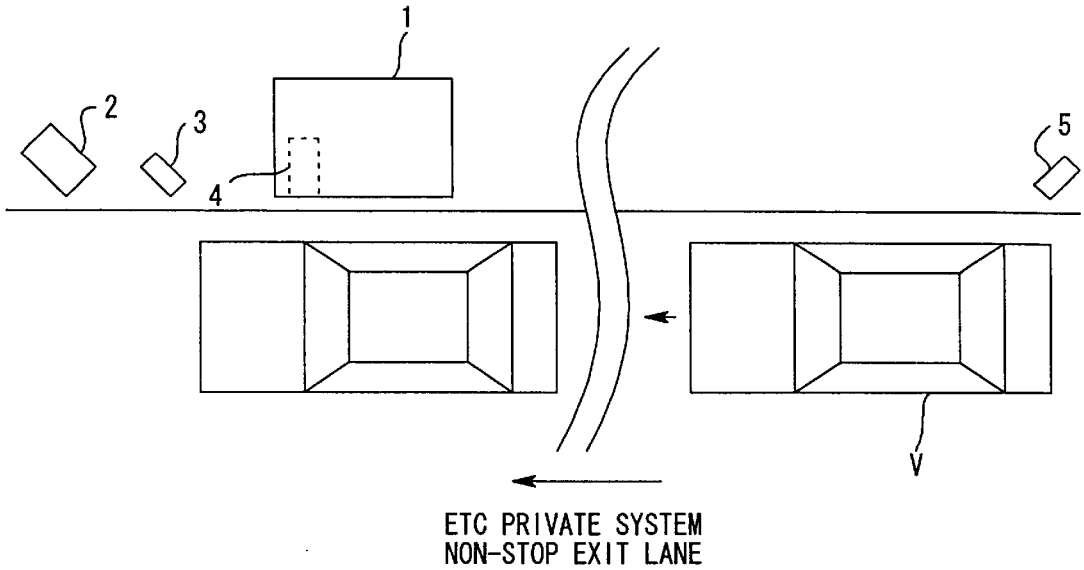
FIG. 1 is a diagram showing an example of the schematic system equipment layout of a toll collection system to which a toll collection apparatus is jointly installed.

FIG. 1 shows an example of schematic layout of the toll collection system equipment of a toll collection system to which a toll collection apparatus 1 of the present invention is jointly installed.

The toll collection apparatus 1 is installed at the rear of a non-stop private lane of a wireless toll collection (ETC) private system. An image pickup device 2 to take a picture of a vehicle number plate and an ITV camera 3 that is a monitor camera are installed near the toll collection apparatus 1. The toll collection apparatus 1 is interlocking with a vehicle detector 4 which detects the entrance and exit of a vehicle V. In this embodiment, a diagram built in the toll collection apparatus 1 is displayed on the vehicle detector 4. However, depending on the state of installation, the vehicle sensor 4 can be installed outside near the toll collection apparatus 1. Further, although normal ETC exit lane side system devices are arranged at the ETC private non-stop exit lane, an unfair protection camera 5 only that is closely related to the present invention is illustrated. That is, the unfair protection camera 5 takes a picture of a number plate of a non-ETC vehicle with which the wireless communication could not be made and the taken image is recognized later.

Figure 2:
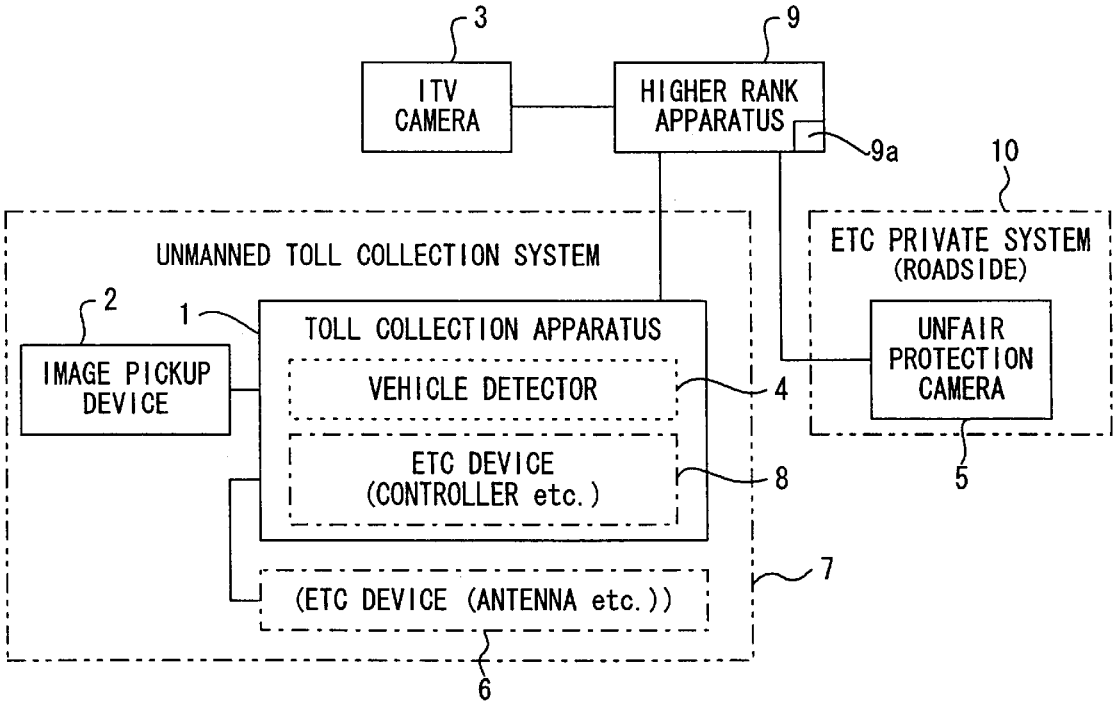
FIG. 2 is a block diagram showing the schematic structure of an unmanned toll collection system to which a toll collection apparatus of the present invention is jointly installed.

FIG. 2 shows the schematic structure of an unmanned toll collection system installed jointly with the toll collection apparatus 1.

The toll collection apparatus 1 comprises an unmanned toll collection system 7 together with ETC device 6 such as the image pickup device 2, an antenna, etc. In FIG. 2, the unmanned toll collection system 7 houses the vehicle sensor 4 and ETC device 8 such as a controller, etc. in the toll collection apparatus 1; however, these devices can be installed outside the toll collection apparatus 1.

Further, the ETC devices concerned with the toll collection apparatus 1 can be replaced by IC card reader/writer depending on the operation of the ETC system.

Further, the image pickup device 2 executes the image process in the later process. An image processor (not shown)

that is used for this image process can be installed independently or realized in combination with another device in one unit. However, this image processor does not become a main element for the explanation of the present invention and therefore, its explanation is omitted.

The toll collection apparatus 1 is connected to a higher rank apparatus 9 such as a monitor, etc. together with an ETC private system (at the road side) 10 including the unfair protection camera 5. Further, the ITV camera 3 explained in FIG. 1 is connected to the higher rank apparatus 9 having the monitor function.

The higher rank apparatus 9 is provided with a memory 9*a* which stores data of enforcing vehicles, etc. The details will be described later.

Figure 3:
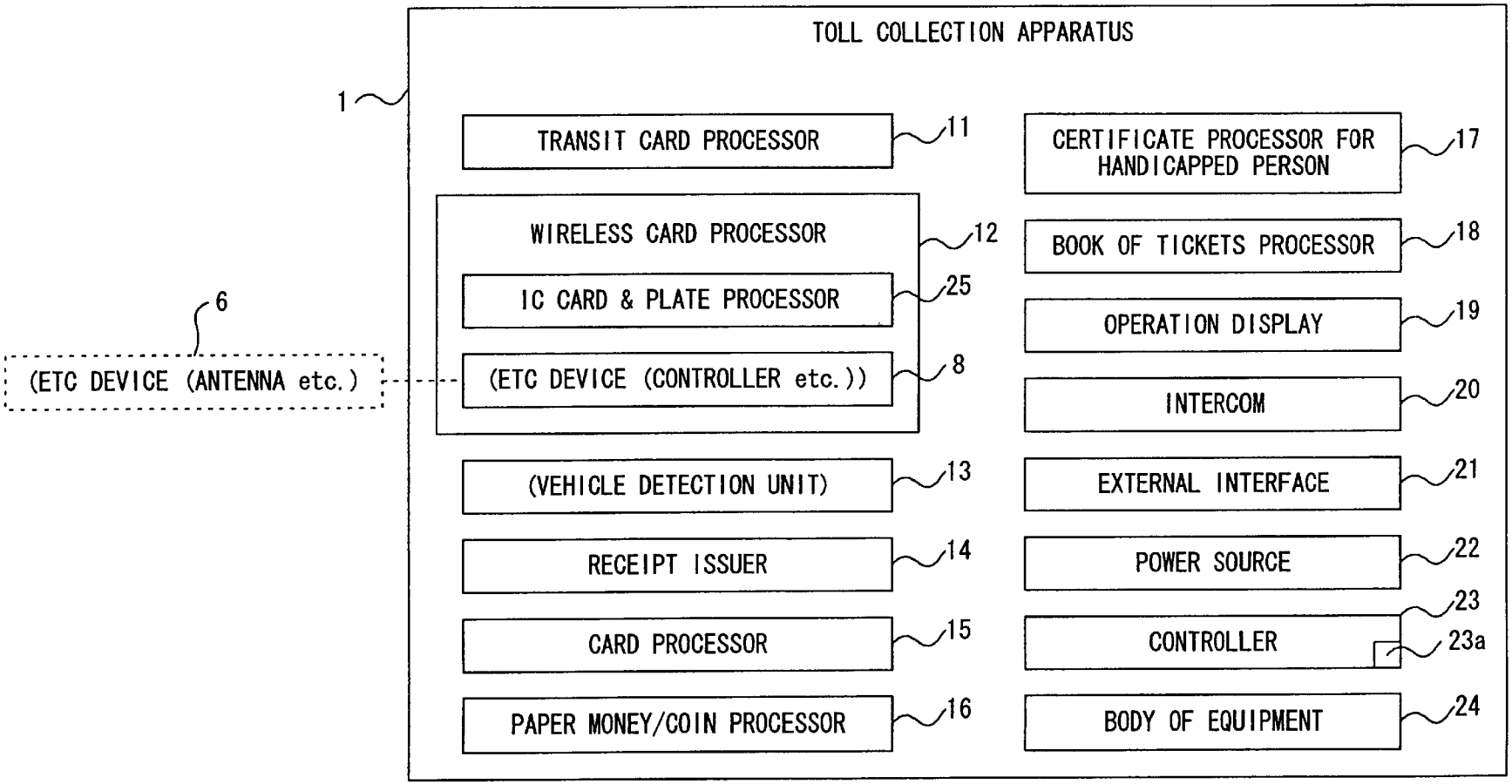
FIG. 3 is a block diagram showing the schematic structure of the toll collection apparatus shown in FIG. 2.

FIG. 3 shows the schematic structure of the toll collection apparatus 1.

The toll collection apparatus 1 comprises a transit card processor 11, a wireless card processor 12, a vehicle detection unit 13 equipped with the vehicle detector 4, a receipt issuer 14, a card processor 15, a paper money/coin processor 16, a certificate processor 17 for handicapped person, a book of ticket processor 18, an operation display including a voice guide function, an intercom 20, an external interface 21, a power source 22, a controller 23 and a body of equipment 24. Further, the wireless card processor 12 has the ETC device 8 and an IC card & plate processor 25. The controller 23 has a memory 23*a* which records an enforcing vehicle data list, number plate data, etc. that will be described later in detail.

Further, the vehicle detector 4 and the ETC device 8 can be installed outside the toll collection apparatus, and depending on the operation of the ETC system, the IC card reader/writer can be used for the ETC process.

Figure 4:
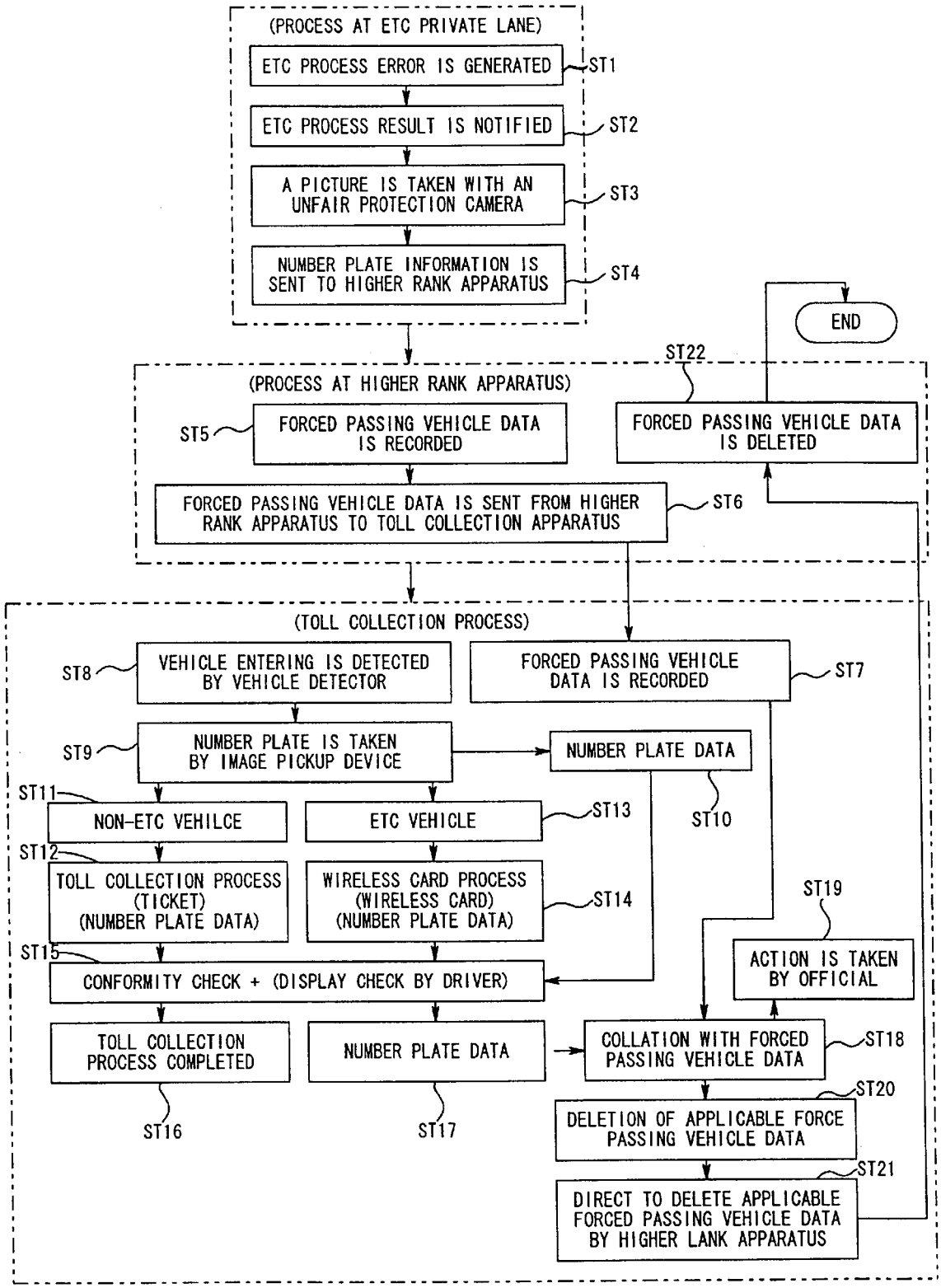
FIG. 4 is a flowchart for explaining the operation of the toll collection process by the toll collection apparatus shown in FIG. 3.

Next, the toll collection process by the toll collection apparatus 1 in such the structure as described above will be described referring to a flowchart shown in FIG. 4.

Now, when it is assumed that an ETC process error is generated at the ETC private operating exit lane for an entering vehicle V, the ETC exit system notifies a driver of this vehicle that an error is generated as a result of the ETC process (ST1) and a toll could not be properly collected through a display (not shown), etc. provided to the ETC private system (the road side) 10 (ST2). The ETC private system (the road side) 10 takes a picture of a number plate of that vehicle V with the unfair protection camera 5 as the vehicle V passes through the exit without paying a toll (ST3). The number plate data N1 of the vehicle V is detected and sent to the higher rank apparatus 9 as an forced passing vehicle (ST4).

The higher rank apparatus 9 records this transmitted number plate data N1 in the memory 9*a* as the forced passing vehicle data (ST5). At the same time, the forced passing vehicle data is sent to the toll collection apparatus 1 (ST6).

The collection apparatus 1 records the number plate data N1 transmitted as the forced passing vehicle data in the forced passing vehicle data list in the memory 23*a* of the controller 23 (ST7). In succession, when the vehicle V is entering in front of the toll collection apparatus 1, the toll collection apparatus 1 detects the entry of the vehicle V (ST8) with the vehicle detector 4 and at the same time, directs the image pickup device 2 to take a picture of the number plate of the vehicle V (ST9). The number plate data taken with the image pickup device 2 is detected and stored in the memory 23*a* as the number plate data N2 of the vehicle V that is subject to the toll collection process (ST10).

The toll collection apparatus 1 performs the toll collection process for the entering vehicle V. At this time, in the toll collection process of a non-ETC vehicle ST11), the toll collection apparatus 1 reads and stores the number plate data N3 recorded on a ticket in the memory 23*a* and obtains an entrance information. In the case of an ETC vehicle (ST13), the ETC device 6 reads and stores the number plate data N3' recorded on a wireless card (IC card) in the memory 23*a* and obtains an entrance information (ST14). Further, the wireless card process can be according to either a system using an IC card reader/writer or a system using a wireless communication antenna.

The, the toll collection apparatus 1 checks the conformity of the number plate data N2 and N3 and N3' stored in the memory 23*a* (ST15). At this time, the toll collection apparatus 1 is also able to display the conformed number plate data N2 or N3 and N3' on the operation display 19 so as to have a driver confirm it (ST15). When the conformity of the number plate data N2 and the number plate N3 recorded on a ticket is confirmed, the toll collection apparatus 1 assumes this number plate data (N2, N3) as N4 (ST17) and collates it with the number plate data N1 recorded on the forced passing vehicle data list in the memory 23*a* as the data of the toll collected vehicle V (ST18).

When they are not agreed with each other as a result of the collation in Step 18, an action is taken by an official (ST19).

When the number plate data N1 as the forced passing vehicle data agreed with the number plate data N4 as the toll collected vehicle data as a result of the collation of them, the toll collection apparatus 1 deletes the number plate data N1 from the forced passing vehicle data list as the toll was collected from the forced passing vehicle (ST20) and directs the higher rank apparatus 9 to delete the forced passing record of that vehicle (ST21).

The high rank apparatus 9 deletes the forced passing vehicle data stored in memory 9*a* according to the number plate data N1 that is the data of a force passing vehicle directed to delete by the toll collection apparatus 1 (ST22) or a step to change data as a toll collected vehicle.

Further, in the case where the ETC process error did not occur in Step ST1, the toll collection apparatus 1 compares the photographed number plate data N2 with the ETC vehicle number plate data N3'. When they agree each other as a result of the comparison, the ETC vehicle is approved to pass the gate. When not agreed, a proper toll is set and input by an official and the toll collection apparatus processes the toll collection.

As described above, according to the embodiment of the present invention, the toll collection apparatus is installed and operated jointly with the wireless toll collection system (ETC). The toll collection apparatus collects tolls certainly from those vehicles that did not intentionally make the forced passing but could not pay tolls for an error of the ETC device, the erroneous entry of non-ETC vehicles out of the vehicles recorded in a toll unpaid vehicle list that is prepared for vehicles from which the toll could not be collected properly at the ETC private non-stop exit lane, etc. At the same time, the toll collection apparatus specifies the vehicles from which tolls were collected after the forced passing process and deletes applicable vehicles data from the forced passing vehicle list. As a result, it becomes possible to prevent drivers who have no malicious intention from being subject to get disadvantage.

According to the present invention described above in detail, it is possible to provide a toll collection apparatus that is installed and operated jointly with a wireless toll collecting system (ETC) and its toll collecting method to certainty collect tolls from vehicles from which tolls could not be collected properly and prevent generation of unintentional forced passing of toll houses.

What is claimed is:

1. A toll collection system, including a toll collection apparatus and a wireless toll collection apparatus, for collecting a toll, comprising:

said wireless toll collection apparatus including:

means for collecting a toll through a wireless communication with a vehicle side;

first take means for taking a vehicle number plate data of the vehicle when said wireless toll collection apparatus could not collect a toll; and means for sending the vehicle number plate data taken by said first take means to said toll collection apparatus as an unfair passage vehicle data;

said toll collection apparatus including:

storage means for storing the vehicle data sent from and sending means;

processing means for collecting a toll from the vehicle;

second take means for taking a vehicle number plate data for the vehicle when the toll collection process is performed by said processing means;

means for inspecting whether the vehicle number plate data of the vehicle taken by said second take means is stored in said storage means; and means for deleting the vehicle number plate data stored as the unfair passage vehicle data from said storage means when said inspecting means found that the vehicle number plate data is stored in said storage means.

2. A toll collection system according to claim 1 further comprising:

means for collating a toll manually when the inspecting means found that the vehicle number plate data is not stored in the storage means.

3. A toll collection method in a toll collection system including a toll collection apparatus and a wireless toll collection apparatus, for toll collecting, comprising:

in said wireless toll collection apparatus:

collecting a toll through a wireless communication with a vehicle side;

first taking a vehicle number plate data of the vehicle when the wireless toll collection apparatus could not collect a toll; and sending the vehicle number plate data taken in said first taking to said toll collection apparatus as an unfair passage vehicle data;

in said toll collection apparatus;

storing the vehicle data from said wireless toll collection apparatus in a storage means;

collecting a toll from the vehicle;

second taking a vehicle number plate data of the vehicle when the toll collection process is performed in said collecting by said toll correcting apparatus; and inspecting whether the vehicle number plate data of the vehicle taken in said second taking is stored in the storage means; and deleting the vehicle number plate data stored as the unfair passage vehicle data from the storage means when said inspecting found that the vehicle number plate data is stored in the storage means.

* * * * *